US005603683A

United States Patent [19]

Lee et al.

[11] Patent Number: 5,603,683

[45] Date of Patent: Feb. 18, 1997

[54] PAPER STACKER DEVICE FOR RECEIVING FANFOLD PAPER WITHOUT ASSISTANCE

[75] Inventors: Ho C. Lee, Endicott; Larry T. Sehringer; Jack L. Zable, both of Vestal, all of N.Y.

[73] Assignee: International Business Machines Corporation, Armonk, N.Y.

[21] Appl. No.: 308,360

[22] Filed: Sep. 14, 1994

[51] Int. Cl.[6] ..... B31B 1/10

[52] U.S. Cl. ..... 493/412; 400/613.2; 493/411; 493/413; 493/414; 493/415

[58] Field of Search ..... 493/410, 411, 493/412, 413, 414, 415; 400/613.2, 613.4, 613.3

[56] References Cited

U.S. PATENT DOCUMENTS

| | | | |
|---|---|---|---|
| 475,487 | 5/1892 | Cochran | 400/613.2 |
| 2,726,465 | 12/1955 | Jespersen | 493/413 |
| 3,514,096 | 5/1970 | Muller | 493/410 |
| 3,640,521 | 2/1972 | Hutley | 493/412 |
| 4,172,592 | 10/1979 | Mueller | 493/413 |
| 5,074,836 | 2/1991 | Fechner | 493/411 |
| 5,074,837 | 12/1991 | Blanton | 493/412 |
| 5,123,893 | 6/1992 | Grooms | 493/411 |
| 5,123,894 | 6/1992 | Bergeman | 400/613.2 |

*Primary Examiner*—Jack W. Lavinder
*Attorney, Agent, or Firm*—Douglas M. Clarkson

[57] ABSTRACT

A paper stacker includes adjustable sides to receive paper passively of different widths. The uppermost ends of the sides are flared to avoid paper encountering these ends, permitting the received paper to slide down between the sides to settle on a bottom surface without assistance. Each of the sides has a portion cut away to permit grasping a paper stack for removal. A trapezoidal platform is located on the bottom between the sides and has a friction material on a substantially flat upper surface to prevent paper slippage.

10 Claims, 2 Drawing Sheets

PAPER STACKER DEVICE FOR RECEIVING FANFOLD PAPER WITHOUT ASSISTANCE

BACKGROUND OF THE INVENTION

1. Field of the Invention

The present invention, generally, relates to devices for receiving fanfold paper being delivered substantially continuously from another mechanism and, more particularly, to a device that will permit such paper to stack itself in a neat, orderly and unassisted manner.

Mechanisms today that use continuous fanfold paper include printers connected with computers, and not all of these are the more expensive kind using powered paper handlers that physically manipulate the paper to put it where it should be stacked. There are many printers of the low cost variety that use paper stackers for handling continuous fanfold paper passively, only guiding the paper where it is to be stacked.

The lower cost printers typically do not include power assist devices, such as patters, wig-wag devices, automated paper output trays or receptacles, etc. Many of the paper stacker devices that are used today rely upon sides extending vertically to keep a paper stack upright.

Without side supports of any kind, there is a tendency for the paper to lean to one side or the other. Usually, the leaning begins early in the stacking process and gets progressively worse as the stack gets higher until the paper stack topples creating a tangled mess.

Even in the case of a more moderately high paper stack, tilting to one side can occur, making it more difficult to handle the paper. Many devices in use today use side supports to prevent such tilting tendencies.

However, use of these side supports to prevent tilting can frequently cause other problems. As the number of sheets builds up and the paper stack gets higher, there is a tendency for these side supports to interfere with the sheets being stacked.

The effect of a sheet contacting a side support creates a frictional force that is transferred backwardly away from the paper stack toward the print line, due to the nature of fanfold paper being connected at both top and bottom to the contiguous sheets. The frictional force and its resulting interference makes it difficult for the free falling sheets to break smoothly along their perforated lines, and the sheets do not stack flat one on the other as the paper stack grows in height.

2. Description of the Prior Art

Previous efforts in this area have developed many devices, some more useful, but most too expensive or impractical to be put into use. Some of these include the following.

U.S. Pat. No. 4,860,904 to Williams granted Aug. 29, 1989, describes a paper stacker structure with a single side member extending from a bottom having a dome shaped center.

U.S. Pat. No. 4,172,592 to Miieller et al. granted Oct. 30, 1979, describes a device for stacking an endless paper web on a movable bottom support.

U.S. Pat. No. 4,622,521 to Scott granted Jun. 11, 1985, describes a printer stand that includes two horizontal surfaces in a spaced position vertically from each other, apparently for storing fanfold paper before use.

U.S. Pat. No. 5,099,996 to Vallis granted Mar. 31, 1992 describes the structure of a tray for holding fanfold paper to be fed to a paper processor.

U.S. Pat. No. 4,095,779 to Imagi et al. granted Jun. 20, 1978 describes a complex structural arrangement for stacking continuous paper from a printer.

While these prior paper stackers may be effective for their stated purposes, what is needed today is a paper stacker that will permit continuous fanfold paper to fold itself neatly, in an orderly manner and without powered assistance, particularly for use in a low cost environment. It is to this end that the present invention is directed. Moreover, when a paper stacker of the present invention is utilized as will be described in detail presently, it provides other advantages not available and not even contemplated by the prior arrangements.

OBJECTS AND SUMMARY OF THE INVENTION

Accordingly, it is a principal object of the present invention to provide a paper stacker of such structural arrangement that it permits continuous fanfold paper to be received and stacked neatly, orderly and unassisted.

An important object of the present invention is to provide a paper stacker structure that is arranged to receive fanfold paper between upright side members without the side members interfering with the paper as it settles into the paper stacker structure.

Another object of the invention is to provide a paper stacker for receiving fanfold paper in a flat manner as it settles in place within the paper stacker.

Briefly, a paper stacker that is constructed and arranged in accordance with the principles of the present invention provides a bottom surface onto which fanfold paper is stacked in a substantially flat and neat manner as it is received between side members without interference and permitted to settle on the bottom surface along its preformed fold lines.

The above and other objects, features and advantages of the present invention will become more apparent from the following detailed description of the presently preferred embodiment as illustrated in the accompanying drawings.

FIG, 2 is an illustration of a prior art paper stacker as an aid in describing the invention.

Figure 3:
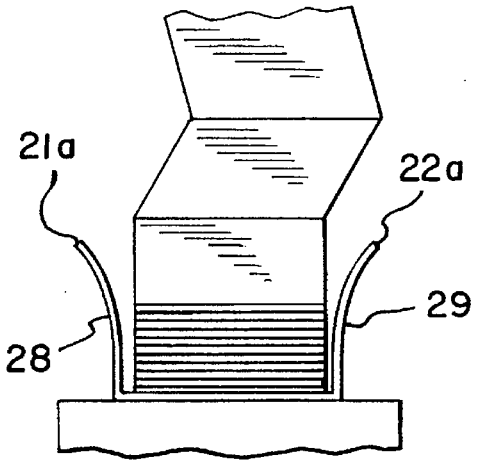
PRIOR ART FIG-3

FIG. 3 is a view illustrating a modification to which the present invention is adaptable.

Figure 4:
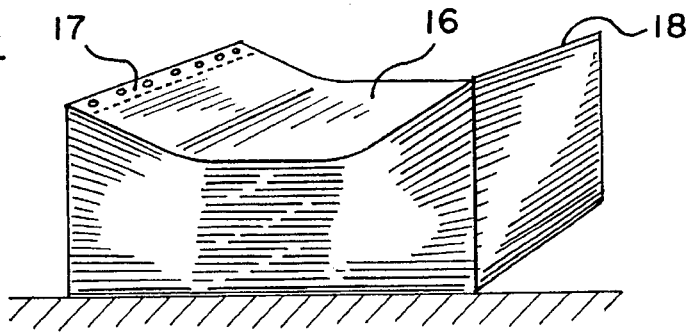

FIG. 4 is a view in perspective illustrating a problem that a structure according to the invention solves.

Figure 5:
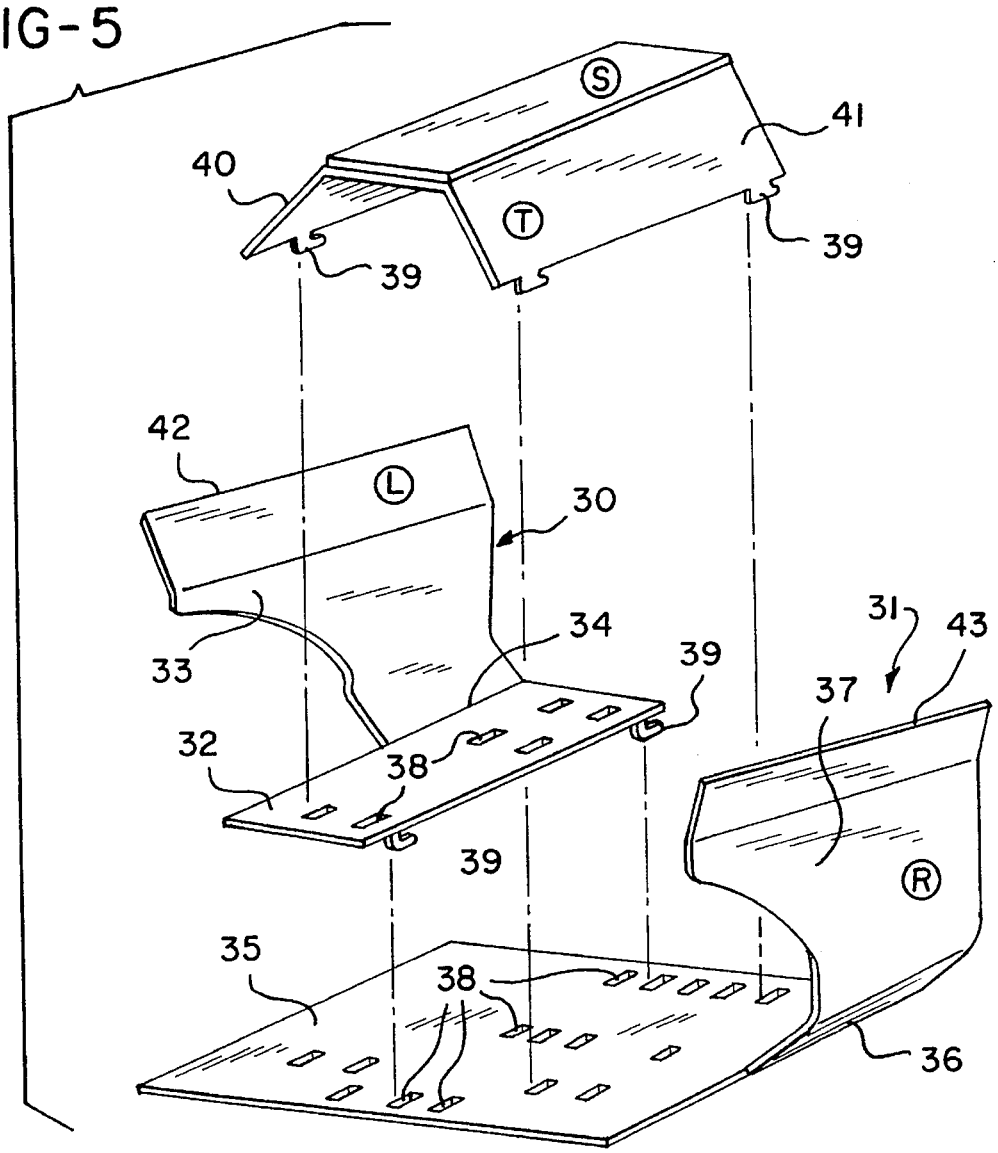

FIG. 5 is an exploded view of a paper stacker of the invention illustrating in perspective a feature of the invention.

DETAILED DESCRIPTION OF THE INVENTION

Figure 1:
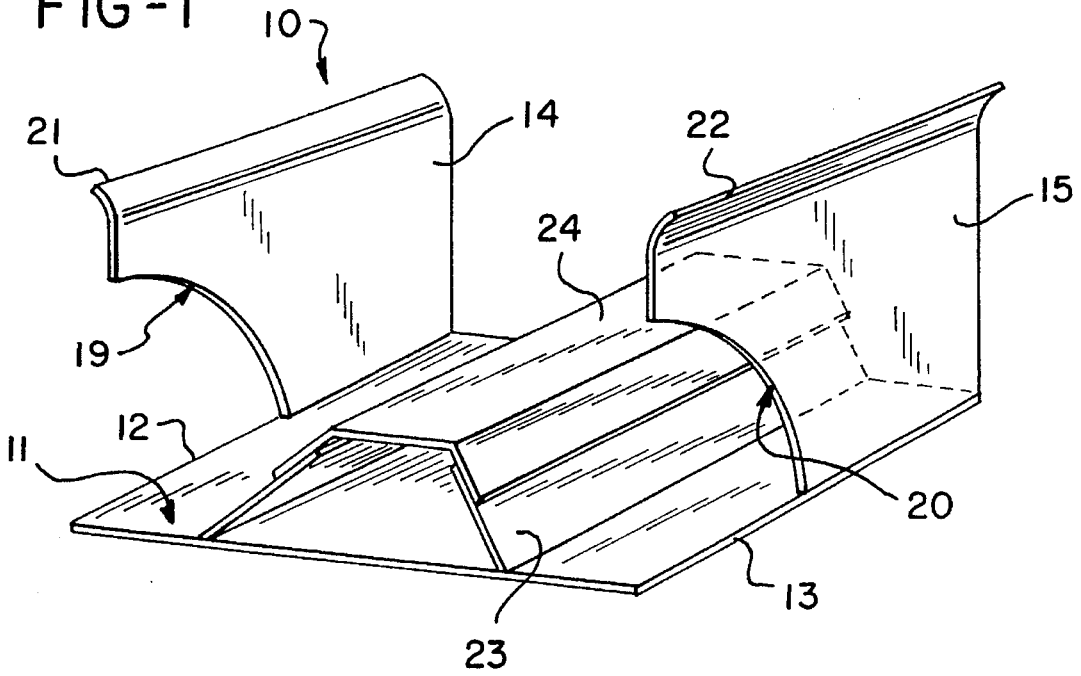
FIG. 1 is a view in perspective of a paper stacker arranged according to the invention.

In FIG. 1 of the drawings, the paper stacker of the invention is identified generally by the numeral 10, which includes a bottom 11 with two edges 12 and 13 extending on opposite sides of the bottom 11. Two side members 14 and 15 are attached to the edges 12 and 13, respectively and extend vertically at substantially right angles with the bottom 11.

The two edges 12 and 13 are spaced apart a distance that allows paper 16, FIG. 4, with sprocket strips 17 and 18 on each side to fit easily between the two side members 14 and 15. Each of the side members 14 and 15 have parts cut away, as shown by the numerals 19 and 20 to permit greater ease in grasping paper stacked on the bottom 11.

The uppermost edges 21 and 22 of the side members 14 and 15, respectively, furthermost from the bottom 11, are flared apart so that the distance between the edges 21 and 22 is greater than the distance between the side members 14 and 15. This feature will be described in more detail hereinafter.

The bottom 11 is continuous from the edge 12 to the edge 13, and supported midway between the edges 12 and 13 is a trapezoidal platform 23 forming a flat surface 24 that is raised a distance above the bottom 11. The trapezoidal platform 23 also will be described in more detail, infra.

The flat surface 24 formed by the trapezoidal platform 23 is coated or covered with a frictional coating of abrasive material. It has been found that a covering of foam rubber is highly effective, and therefore, when another coating material is used, it should provide a similar friction between the flat surface 24 and a sheet being supported on the bottom 11.

Figure 2:
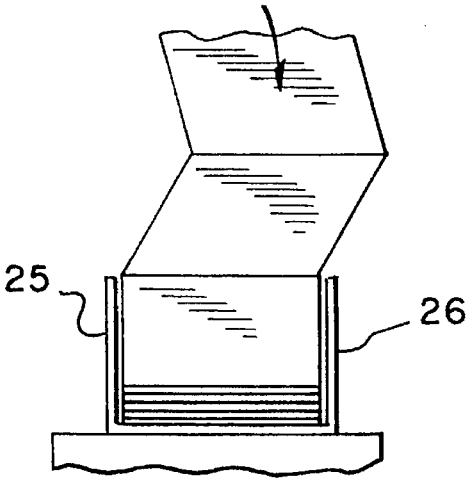

FIG. 2 of the drawings illustrates a prior art arrangement of sides 25 and 26 and shows the straight position in which they are formed. Fanfold paper 27 being received between these sides will eventually encounter one of them, and as described, supra, such an encounter will interfere with a passive stacking action resulting in frictional forces that prevent the paper from breaking smoothly along their perforated lines.

FIG. 3 illustrates a modification to which the invention is adaptable. Here the sides 28 and 29 are formed somewhat arcuate in their configuration, making the uppermost edges 21*a* and 22*a* about the same distance apart, as 21 and 22 in FIG. 1. While a radius of this curvature may be any suitable amount, approximately 12 inches is entirely satisfactory.

FIG. 4 illustrates a fault in paper stacking that is overcome in a paper stacker according to the present invention. The edges of the stack of fanfold paper curl up because of damage to the sprocket hole side strips 17 and 18 making the center 16 lower in height.

While it may appear reasonable to simply increase the height of a central surface 24, FIG. 1, such a surface must present a flat surface to be effective. Other configurations cause paper slippage, and the like, action. Moreover, a polished surface of any configuration is not as desirable.

Therefore, according to the invention, compensation is provided for the sides with the sprocket hole strips being higher than the center to reduce a tendency for the stack to lean or to tilt to one side. However, it has been found that simply increasing the height with any form of central platform surface alone is insufficient to prevent toppling of a paper stack. The surface of the raised platform must be flat, and it cannot be polished but must be of a frictional material.

FIG. 5 illustrates a paper stacker 10 that is formed to include all features of the invention. That is, the paper stacker 10 is formed of three principal sections identified by the letters L, R and T, with the flat frictional surface identified by S.

The section L locks with the section R by means of appropriately located tabs fitting with appropriately located slots. The number and the location of the slots permit an adjustment of the distance between the two sides 30 and 31 to accommodate different widths of paper and the flat surface S being positioned substantially midway between the two side members.

The side 30 is formed with a horizontal bottom 32 and a substantially vertical side member 33 fixedly attached at an edge 34. The side 31 is formed similarly, with a horizontal bottom 35 affixed at an edge 36 to a substantially vertical side member 37. Both of the bottoms 32 and 35 have slots 38 of any configuration to receive matching tabs 39.

The matching tabs 39 extend from the under side of the bottom 32 and from the lower edges of the trapezoidal platform supporting the flat surface S. Note that in this view, the frictional flat surface S does not extend down onto the sloping sides 40 and 41 of the trapezoidal platform, which is only a matter of preference, not affecting its function.

Note also that in this FIG. 5, the uppermost edges 42 and 43 of the sides 30 and 31, respectively, are on straight sections, not curved as shown in FIG. 1 or arcuate as in FIG. 3.

When the uppermost edges 42 and 43 are on straight sections, as in FIG. 5, they should be flared outwardly away from each other in the order of 10 degrees. It has been found that a 10 degree flare is sufficient to prevent paper from encountering these uppermost edges.

When the uppermost edges are flared slightly, such as in the order of 10 degrees, these edges can be a distance apart an amount equal to approximately 10.5 inches, which will permit 9.5 inch wide paper to be received readily and to settle between the side members to the bottom without creating a problem.

Preferably, the trapezoidal platform should be in the order of three inches in height above the bottom, and also preferably, that dimension is ±⅛th inch to achieve a maximum advantage.

Clearly, the height of the side members above the bottom of the paper stacker 10 can vary according to a particular requirement, but it has been found that an optimum is 7 ¾ inches with an optimum of ±½ inch variation. The particular sponge material that permits achieving optimum results is ½ inch thick and is made by "Soundcoat".

The invention has been shown, described and illustrated in substantial detail with reference to the presently preferred form of the invention. It will be understood by those skilled in this art that various changes and modifications may be made without departing from the spirit and scope of the invention which is defined by the claims appended hereto.

What is claimed is:

1. A paper stacker device for receiving continuous fanfold paper permitting the paper to stack itself in a neat, orderly and unassisted manner, comprising:

paper receiver means having bottom means with first and second opposite edges, said bottom means being formed to support fanfold paper as it is received in a continuous manner;

said paper receiver means also having two side means extending away from each other in an arcuate configuration over a substantial portion of their height from said first opposite edges of said bottom means;

said paper receiver means formed by said bottom means and said two side means being substantially open along said second opposite edges; and said two side means having ends furthermost from said bottom means flared away from each other;

whereby said continuous fanfold paper is received between said two side means without obstruction and permitted to settle on said bottom means neatly, orderly and without assistance.

2. A paper stacker device for receiving continuous fanfold paper permitting the paper to stack itself in a neat, orderly and unassisted manner, comprising:

paper receiver means having bottom means with first and second opposite edges, said bottom means being formed to support fanfold paper as it is received in a continuous manner;

said paper receiver means also having two side means extending in an arcuate configuration over a substantial portion of their height from said first opposite edges of said bottom means;

said paper receiver means formed by said bottom means and said two side means being substantially open along said second opposite edges; and said two side means having ends furthermost from said bottom means flared away from each other, and said ends furthermost from said bottom are the ends of sections of said side means that are substantially straight and are at an angle with the vertical that is in the order of 10 degrees;

whereby said continuous fanfold paper is received between said two side means without obstruction and permitted to settle on said bottom means neatly, orderly and without assistance.

3. A paper stacker device as defined by claim 1 wherein said paper receiver means with said two side means being substantially open along said second opposite edges is identified as its front and back.

4. A paper stacker device as defined by claim 1 including means defining a substantially flat region in the order of 3 inches above said bottom means and located substantially midway between said two side means.

5. A paper stacker device as defined by claim 1 wherein said two side means are adjustable in position to permit receiving paper of different sizes.

6. A paper stacker device as defined by claim 1 wherein said device includes at least three sections fitted together by detachable means to permit the reception and stacking passively material of different sizes.

7. A paper stacker device as defined by claim 1 wherein said two side means include arcuate and straight portion with ends furthermost from said bottom means flared apart to a predetermined degree.

8. A paper stacker device for receiving continuous fanfold paper permitting the paper to stack itself in a neat, orderly and unassisted manner, comprising:

paper receiver means having bottom means with first and second opposite edges, said bottom means being formed to support fanfold paper as it is received in a continuous manner;

said paper receiver means also having two side means extending substantially vertically from said first opposite edges of said bottom means;

said two side means extend above said bottom means in the order of 8 inches, and each having cutouts to permit easy pick up of stacked paper;

said paper receiver means formed by said bottom means and said two side means being substantially open along said second opposite edges; and said two side means extending substantially vertically having ends furthermost from said bottom means flared away from each other;

whereby said continuous fanfold paper is received between said two side means without obstruction and permitted to settle on said bottom means neatly, orderly and without assistance.

9. A paper stacker device for receiving continuous fanfold paper permitting the paper to stack itself in a neat, orderly and unassisted manner, comprising:

paper receiver means having-bottom means with first and second opposite edges, said bottom means being formed to support fanfold paper as it is received in a continuous manner;

said paper receiver means also having two side means extending substantially vertically from said first opposite edges of said bottom means;

a trapezoidal configuration having a substantially flat surface approximately midway between said two side means, and said substantially flat surface being coated with a predetermined frictional material;

said paper receiver means formed by said bottom means and said two side means being substantially open along said second opposite edges; and said two side means extending substantially vertically having ends furthermost from said bottom means flared away from each other;

whereby said continuous fanfold paper is received between said two side means without obstruction and permitted to settle on said bottom means neatly, orderly and without assistance.

10. A paper stacker device for receiving continuous fanfold paper permitting the paper to stack itself in a neat, orderly and unassisted manner, comprising:

paper receiver means having bottom means with first and second opposite edges, said bottom means being formed to support fanfold paper as it is received in a continuous manner;

said paper receiver means also having two side means extending substantially vertically from said first opposite edges of said bottom means;

said paper receiver means formed by said bottom means and said two side means being substantially open along said second opposite edges;

said two side means are formed separately with separate portion of a bottom surface, separate trapezoidal platform means having a substantially flat surface, means to affix said trapezoidal platform means detachably to said bottom means, and a material with predetermined frictional characteristics on said substantially flat surface of said trapezoidal platform means for preventing said fanfold paper from slipping; and said two side means extending substantially vertically having ends furthermost from said bottom means flared away from each other;

whereby said continuous fanfold paper is received between said two side means without obstruction and permitted to settle on said bottom means neatly, orderly and without assistance.

* * * * *